US007607628B2

(12) United States Patent
Elder et al.

(10) Patent No.: US 7,607,628 B2
(45) Date of Patent: Oct. 27, 2009

(54) PALLET

(75) Inventors: Andrew W. Elder, Carmel, IN (US); William J. Skinner, Plainfield, IN (US); Bobby G. Badger, Merrifield, MN (US)

(73) Assignee: Stratis Corporation, Indianapolis, IN (US)

( * ) Notice: Subject to any disclaimer, the term of this patent is extended or adjusted under 35 U.S.C. 154(b) by 0 days.

(21) Appl. No.: 10/116,715

(22) Filed: Apr. 3, 2002

(65) Prior Publication Data

US 2003/0189152 A1 Oct. 9, 2003

(51) Int. Cl.
*B65D 19/00* (2006.01)
*B65D 19/38* (2006.01)

(52) U.S. Cl. ..... 248/346.02; 108/57.25; 108/57.28; 108/53.3; 206/599; 248/346.01

(58) Field of Classification Search ..... 248/346.02, 248/346.01; 108/51.11, 57.25, 57.26, 57.27, 108/57.28, 53.3, 53.1, 55.3, 56.1, 901; 206/599, 206/511
See application file for complete search history.

(56) References Cited

U.S. PATENT DOCUMENTS 1,349,458 A 8/1920 Johnson
2,451,226 A 10/1948 Kemp, Jr.
2,662,711 A 12/1953 Lapham
3,187,691 A 6/1965 Leitzel
3,199,469 A 8/1965 Sullivan
3,204,583 A 9/1965 Nicholson
3,228,358 A 1/1966 Sepe et al.
3,424,110 A 1/1969 Toot
3,526,195 A 9/1970 Maryonovich
3,561,375 A 2/1971 Hammond
3,611,952 A * 10/1971 Hoffman ..... 108/11
3,636,889 A 1/1972 Mangold
3,641,949 A * 2/1972 Monk ..... 108/53.3
3,702,100 A 11/1972 Wharton
3,707,127 A 12/1972 Palfey
3,719,157 A 3/1973 Arcocha et al.
3,720,176 A * 3/1973 Munroe ..... 108/57.25
3,750,596 A 8/1973 Box
3,762,342 A 10/1973 Lawlor (Continued)

FOREIGN PATENT DOCUMENTS

DE 1 214 153 4/1966

(Continued)

*Primary Examiner*—Amy J. Sterling
*Assistant Examiner*—Tan Le
(74) *Attorney, Agent, or Firm*—Merchant & Gould PC

(57) ABSTRACT

A pallet includes a deck and support members extending from an underside of the deck. The deck has alignment recesses as well as lowered portions along both sides of the deck for receiving the feet and runners supporting the deck to achieve nesting when stacked. The support members include two runners with orifices extending there through and aligned to accommodate pallet jacks and forklifts. The orifices have straps extending underneath the orifices to provide structural support while allowing for insertion of pallet jacks and their wheels. The pallet has feet between the runners and spaced so that the underside of the deck is unobstructed in the area intermediate the orifices providing for four way insertion of pallet jack support units. The pallet has alignment sections machined into the sides of the pallet to provide for precise alignment with pallet handling equipment.

5 Claims, 9 Drawing Sheets

U.S. PATENT DOCUMENTS

| | | | | | |
|---|---|---|---|---|---|
| 3,814,031 | A | * | 6/1974 | Fowler | 108/57.28 |
| 3,880,093 | A | | 4/1975 | Schott | |
| D237,475 | S | | 11/1975 | Cardwell et al. | |
| 3,926,321 | A | | 12/1975 | Trebilcock | |
| 3,944,070 | A | | 3/1976 | Cardwell et al. | |
| 3,948,190 | A | | 4/1976 | Cook, III et al. | |
| 3,962,660 | A | | 6/1976 | Duckett | |
| 4,000,704 | A | | 1/1977 | Griffin, Jr. | |
| 4,029,023 | A | | 6/1977 | Rosewicz et al. | |
| 4,198,795 | A | | 4/1980 | Barnidge | |
| D256,904 | S | | 9/1980 | Persson | |
| 4,226,192 | A | | 10/1980 | Myers | |
| 4,248,163 | A | * | 2/1981 | Caughey et al. | 108/53.3 |
| 4,254,873 | A | * | 3/1981 | Cook et al. | 206/599 |
| 4,301,743 | A | | 11/1981 | Keller | |
| 4,318,351 | A | | 3/1982 | Munk | |
| D267,126 | S | | 11/1982 | Jonebrant | |
| 4,424,752 | A | | 1/1984 | Aberg | |
| 4,425,852 | A | | 1/1984 | Riviere | |
| 4,428,306 | A | | 1/1984 | Dresen et al. | |
| 4,480,748 | A | | 11/1984 | Wind | |
| D283,267 | S | | 4/1986 | Kero et al. | |
| 4,619,207 | A | * | 10/1986 | Boyce et al. | 108/53.3 |
| D289,939 | S | | 5/1987 | Dash | |
| 4,674,414 | A | | 6/1987 | Nulle et al. | |
| 4,694,962 | A | | 9/1987 | Taub | |
| 4,838,176 | A | | 6/1989 | Bowser, Sr. et al. | |
| 4,879,956 | A | | 11/1989 | Shuert | |
| 5,046,434 | A | | 9/1991 | Breezer et al. | |
| 5,052,307 | A | | 10/1991 | Morrison | |
| D348,136 | S | | 6/1994 | Haag et al. | |
| 5,341,748 | A | | 8/1994 | Liu | |
| 5,408,937 | A | | 4/1995 | Knight, IV et al. | |
| 5,476,048 | A | | 12/1995 | Yamashita et al. | |
| 5,513,577 | A | * | 5/1996 | Weis | 108/56.3 |
| D371,670 | S | * | 7/1996 | Carlsson | D34/38 |
| 5,546,872 | A | * | 8/1996 | Young | 108/56.1 |
| D374,536 | S | | 10/1996 | Elder et al. | |
| 5,606,921 | A | | 3/1997 | Elder et al. | |
| 5,638,760 | A | | 6/1997 | Jordan et al. | |
| 5,664,934 | A | | 9/1997 | Schaede et al. | |
| 5,667,065 | A | | 9/1997 | Fahrion | |
| D393,519 | S | | 4/1998 | Wail et al. | |
| 5,769,003 | A | | 6/1998 | Rose et al. | |
| 5,809,902 | A | | 9/1998 | Zetterberg | |
| D400,681 | S | | 11/1998 | Sadr | |
| D404,179 | S | | 1/1999 | Apps et al. | |
| D408,610 | S | | 4/1999 | Mathias | |
| 5,921,188 | A | | 7/1999 | Kohlhaas | |
| 5,964,162 | A | * | 10/1999 | Chuan-Jen | 108/57.28 |
| 6,155,181 | A | | 12/2000 | Chilcutt | |
| 6,220,183 | B1 | | 4/2001 | Schwitzky | |
| 6,352,039 | B1 | * | 3/2002 | Woods et al. | 108/57.25 |
| 6,354,229 | B1 | | 3/2002 | Heidtke | |
| 6,389,990 | B1 | * | 5/2002 | Apps | 108/57.25 |
| 6,874,428 | B2 | * | 4/2005 | Apps | 108/57.25 |

FOREIGN PATENT DOCUMENTS

| | | | |
|---|---|---|---|
| DE | 298 21 779 | U1 | 3/1999 |
| EP | 0 487 180 | A1 | 5/1992 |
| EP | 0 523 737 | A2 | 1/1993 |
| EP | 0 523 737 | A3 | 1/1993 |
| EP | 0 725 010 | A1 | 8/1996 |
| FR | 2 666 069 | A1 | 2/1992 |
| NL | 9002386 | | 6/1991 |
| WO | WO 98/34840 | | 8/1998 |

* cited by examiner

PALLET

BACKGROUND OF THE INVENTION

1. Field of the Invention

The present invention relates to a pallet and in particular, to a pallet providing improved positioning features and a support system that provides for easier handling and access by handling equipment.

2. Description of the Prior Art

Pallets for supporting and moving various types of articles are well known. Pallets are made from many materials, including wood, metal, fiberglass or plastic, depending on the intended use and environment in which the pallets are used. Pallets generally provide a planar upper support surface and are adapted for use with many types of loading equipment, lifting by cranes, forklifts, hand trucks or other specialized handling equipment.

Pallets are typically constructed with a planar supporting surface having runners or sets of legs, often referred to as feet, extending downward there from to elevate the articles being supported off the ground to prevent moisture, dirt and other debris from coming into contact with the supported articles. When not in use, the pallets are often stored in a stacked configuration. However, the stacks may become very high and the amount of space required for storing the pallets may be quite extensive. In addition, the pallets may easily slide relative to one another, making the stacks very unstable and creating a danger from pallets sliding and falling. To overcome this problem, deep indentations have been made on the upper surface of the pallets to provide nesting. However, some articles, such as sheets of paper, are supported on the pallet, the weight of the paper mass may cause damage to the bottom sheets over the indentations. Such indentations in the paper may make some of the paper unsuitable for use, thereby increasing cost. U.S. Pat. No. 5,606,921 to Elder et al shows a pallet that provides an improvement for stacking pallets and providing nesting while minimizing damage to articles stored on the pallet.

Although U.S. Pat. No. 5,606,921 provides improved stacking and decreased sliding from nesting, it does not use runners, which are preferred in some pallet applications. Providing a surface that does not damage material such as paper while also locking pallets together when stacked become much more difficult when elongate runners are utilized due to their shape and size. Moreover, providing easy access for pallet jacks and forklifts when runners are utilized while maintaining sufficient support provides special design challenges.

Indexing pallets for use with pallet handling equipment is often needed. U.S. Pat. No. 6,209,464 provides an indexed pallet that provides excellent alignment. However, the pallet may not be compatible with all handling equipment. Some handling equipment requires very specific tolerances that engage alignment structure on the sides of the pallet. Problems may arise, as molded patents typically cannot meet some of the tolerances required to properly align the pallets. Utilizing a method to machine the sides of the pallets may create waves along the side of the pallet, requiring further machining and in some instances, ruining the pallet. Further problems may arise when pallets are utilized with conveyors having rollers. The edges of the pallets may abut the roller at a poor engagement angle and make movement more difficult or less smooth, due to the engagement between the pallet and roller not being sufficiently gradual.

It can be seen that a new and improved pallet is required. Such a pallet should provide for use of support runners while also providing nesting to minimize sliding and providing for access with either a forklift or pallet jack from all four sides. In addition, when lifted by a pallet jack or forklift, the tines should engage the underside of the deck to improve load distribution. Such a pallet should also provide for improved indexing and handling with various types of equipment and achieve improved alignment tolerances with a simple manufacturing method. In addition, the runners should provide adequate support while maintaining a lightweight configuration and also be easily utilized with various types of conveyors and rollers. The present invention addresses these as well as other problems associated with pallets.

SUMMARY OF THE INVENTION

The present invention is directed to a pallet, and in particular to a pallet having improved alignment and engagement with handling equipment and articles being supported.

The pallet has a substantially rectangular configuration with a planar upper deck having channels formed therein. The upper surface of the deck also includes recesses aligning with legs or feet of other similar pallets to provide for nesting of the pallets when stacked while empty. The pallets of the present invention include runners extending along opposed sides of the pallet. The upper surface of the deck has slight recessed portions along opposed sides to accommodate the runners for stacking. The recessed portions allow for engagement of the alignment portions with the feet as well as accommodating the runners. With this configuration, nesting is accomplished while maintaining stability without deep recesses that could damage articles stored on the pallet.

The support configuration of the pallet includes two runners and three spaced apart support legs, or feet, intermediate the runners. The runners have horizontal orifices formed transversely to the longitudinal direction that allow for four-way entry of forklifts or hand trucks. The orifices in the runners are molded so as to have a slight taper to help alignment and insertion of hand trucks or forklift tines. A recess is formed in the lower surface of the deck proximate the runners' orifices to provide space for locking an insert to the mold during molding. The recess provides for a runner orifice having an upper surface substantially aligned with the lower surface of the deck, thereby avoiding a step down from the underside of the deck or increasing the height of the runner. The runners also include thin straps providing structural support beneath the orifices, while still allowing wheels of a hand truck to easily roll over the straps. The straps also include a pattern of dimples formed in their bottom surface to provide structural support and rigidity. Between the orifices are support cones extending upward from the bottom surface of the runner. The cones may be either substantially rectangular or substantially circular and decrease the overall weight of the pallet while also providing structural support to the runners. The rectangular and circular runners may be matched or mixed in pairs, depending on the needs and the application of the pallet.

In one aspect of the present invention, the side of the pallet has alignment sections. The alignment sections protrude outward and are slightly thicker than the sidewalls of the pallet. The alignment sections allow for engagement with pallet handling equipment and precise positioning of the pallets relative to the equipment. As molded pallets cannot obtain the tolerances sought with conventional rotational molding techniques, the alignment sections are made through an improved method. According to the present invention, the pallet is molded with the alignment sections protruding outward at approximately the preselected positions and distances. The alignment sections are molded with greater thickness than the sidewalls and protrude outward, with excess material provided over the final material needs. In this manner, precise equipment can be utilized to machine the alignment sections to remove excess material and achieve tolerances and distances within those required for alignment with precise handling equipment. The alignment sections avoid problems with waves from machining an entire side of the pallet.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in that there is illustrated and described a preferred embodiment of the invention.

BRIEF DESCRIPTION OF THE DRAWINGS

Referring now to the drawings, wherein like reference numerals and letters indicate corresponding structure throughout the several views.

DETAILED DESCRIPTION OF THE PREFERRED EMBODIMENT

Figure 1:
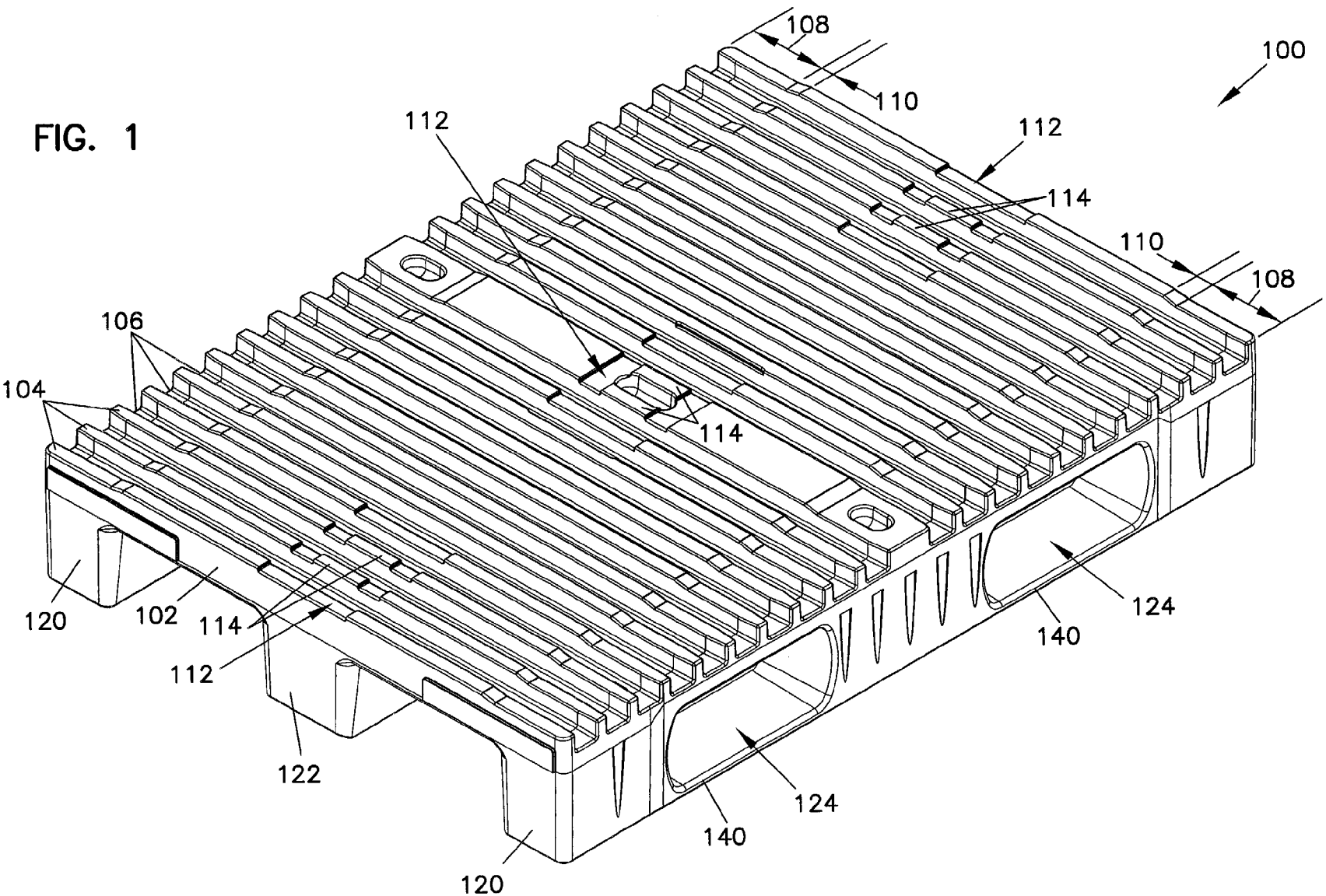
FIG. 1 is a top perspective view of a pallet according to the principles of the present invention.
Figure 3:
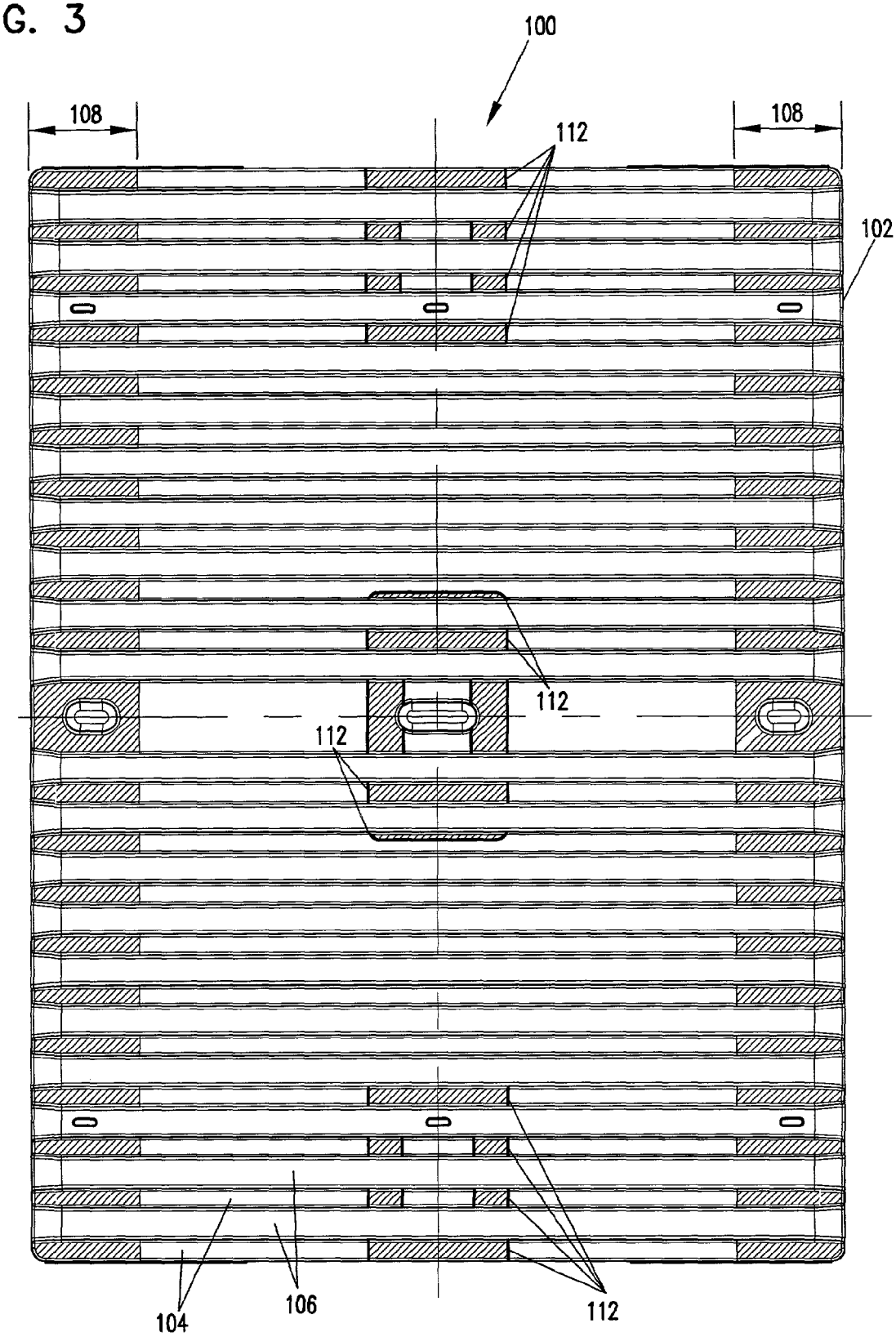
FIG. 3 is a top plan view of the pallet shown in FIG. 1.
Figure 7:
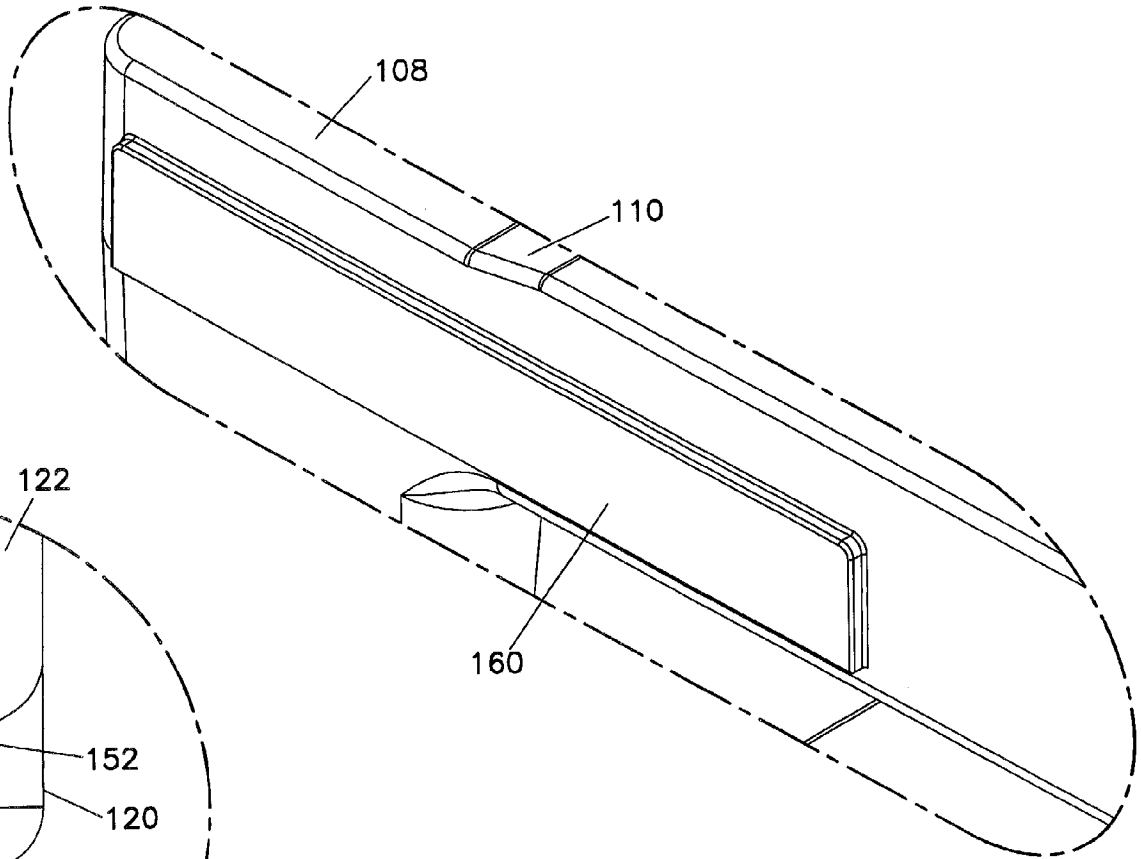
FIG. 7 is a detail perspective view of the pallet shown in FIG. 1 showing a side alignment section.
Figure 10:
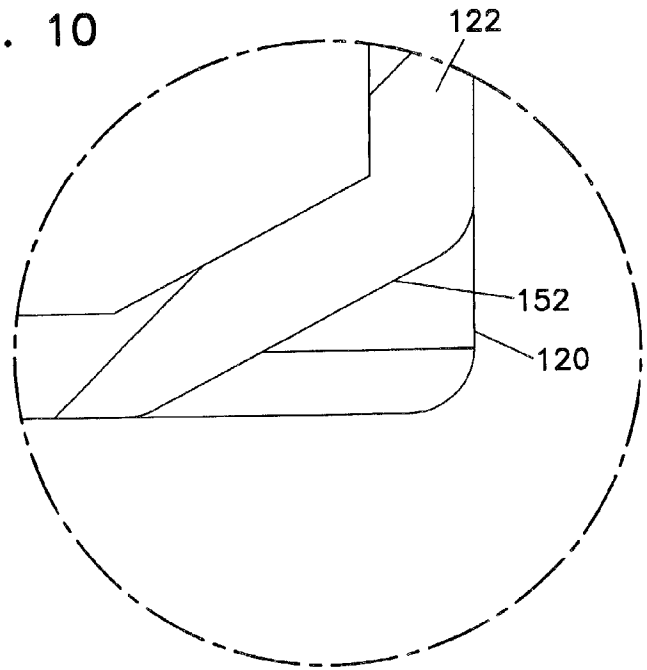
FIG. 10 is a side view of the portion of a support member shown in FIG. 9.

Referring now to the drawings, and in particular to FIG. 1, there is shown a pallet, generally designated 100. The pallet 100 includes a typically rectangular deck having parallel ribs 104 extending across the width of the deck 102. The ribs 104 form channels 106 there between, which widen from the center to the edges of the deck 102 while the centerlines of the channels 106 remain spaced equidistant from one another in a preferred embodiment. The ribs 104 are tapered at their ends to allow insertion of tines for lifting objects from the upper surface of the deck 102. The upper surface of the deck 102 also includes recesses 112 having raised center portions 114 that extend upward to the upper surface of the deck 102. The recesses 112, as best shown in FIG. 3, receive the bottoms of legs 122, best shown in FIG. 4, to provide for nesting of the pallets 100 when stacked while empty. The legs 122, also commonly called feet, include bottom recesses 150 that receive the center portions 114 of an adjacent pallet 100. With this configuration, the pallets 100 nest to some degree and prevent sliding when stacked. In addition, the pallets 100 include runners 120, that rest on a lowered portion 108 extending along each side of the pallet deck 102, as shown in FIGS. 1, 3 and 7. The lowered portion 108 also include an angled step-down portion 110 to transition from the center portion of the deck to the lowered portion 108. The recesses 112 and lowered portion 108 are typically lowered the same distance from the uppermost surface of the deck 102. In a preferred embodiment, the center portions 114 and lowered portions 108 are recessed 3 mm. It has been found that this distance still provides sufficient support for the material such as paper that may be stored on the pallet 100 without damaging the bottom most sheets. This is accomplished while also providing sufficient resistance to sliding when stacked to prevent the pallets 100 from becoming misaligned when stacked while empty.

Figure 2:
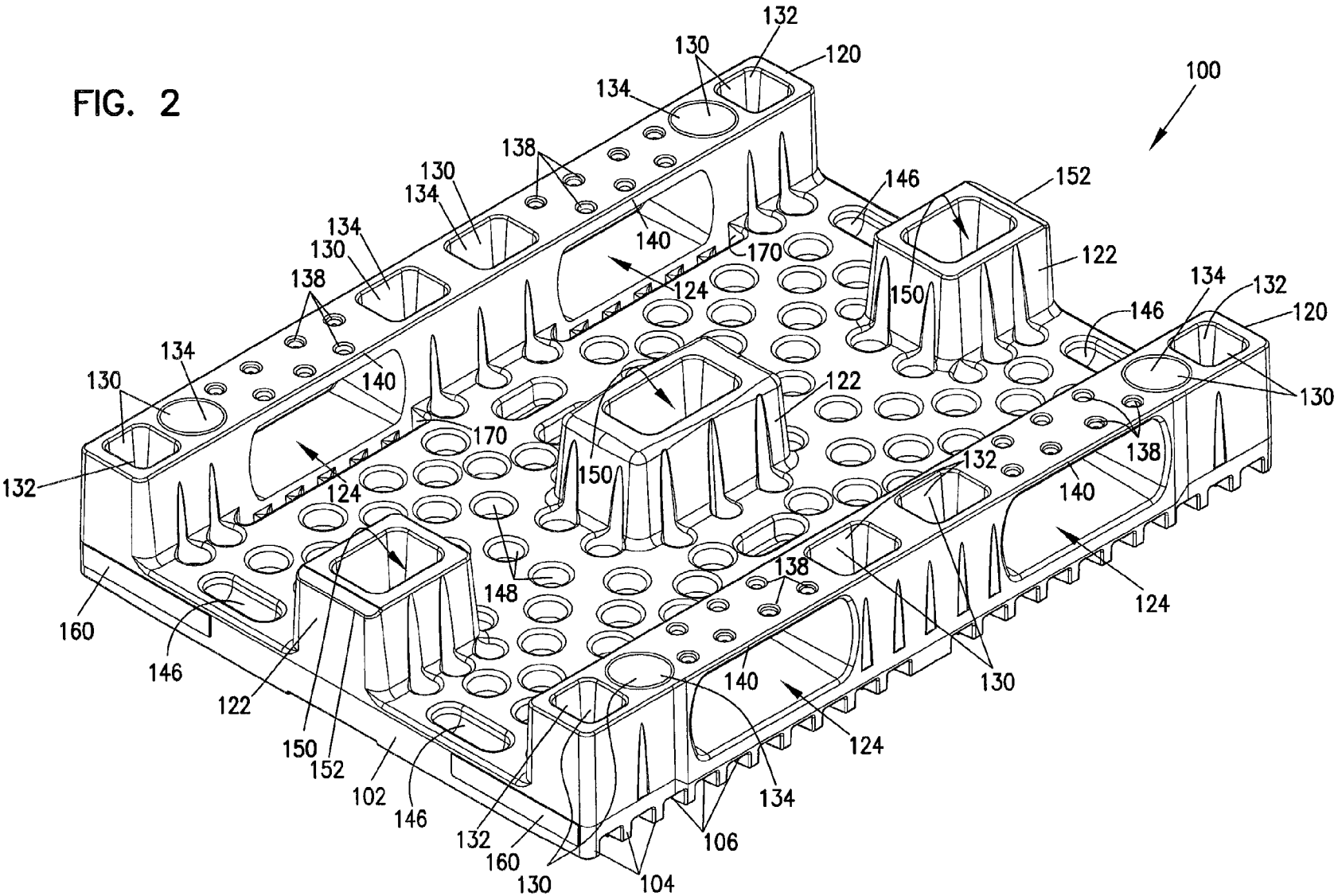
FIG. 2 is a bottom perspective view of the pallet shown in FIG. 1.
Figure 5:
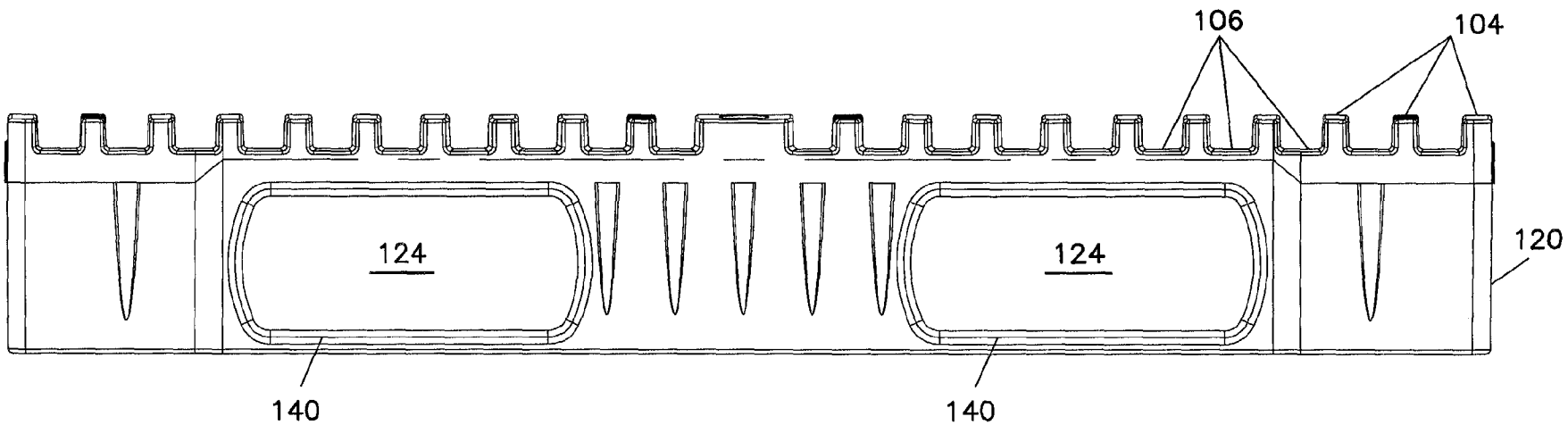
FIG. 5 is a side elevational view of the pallet shown in FIG. 1.
Figure 8:
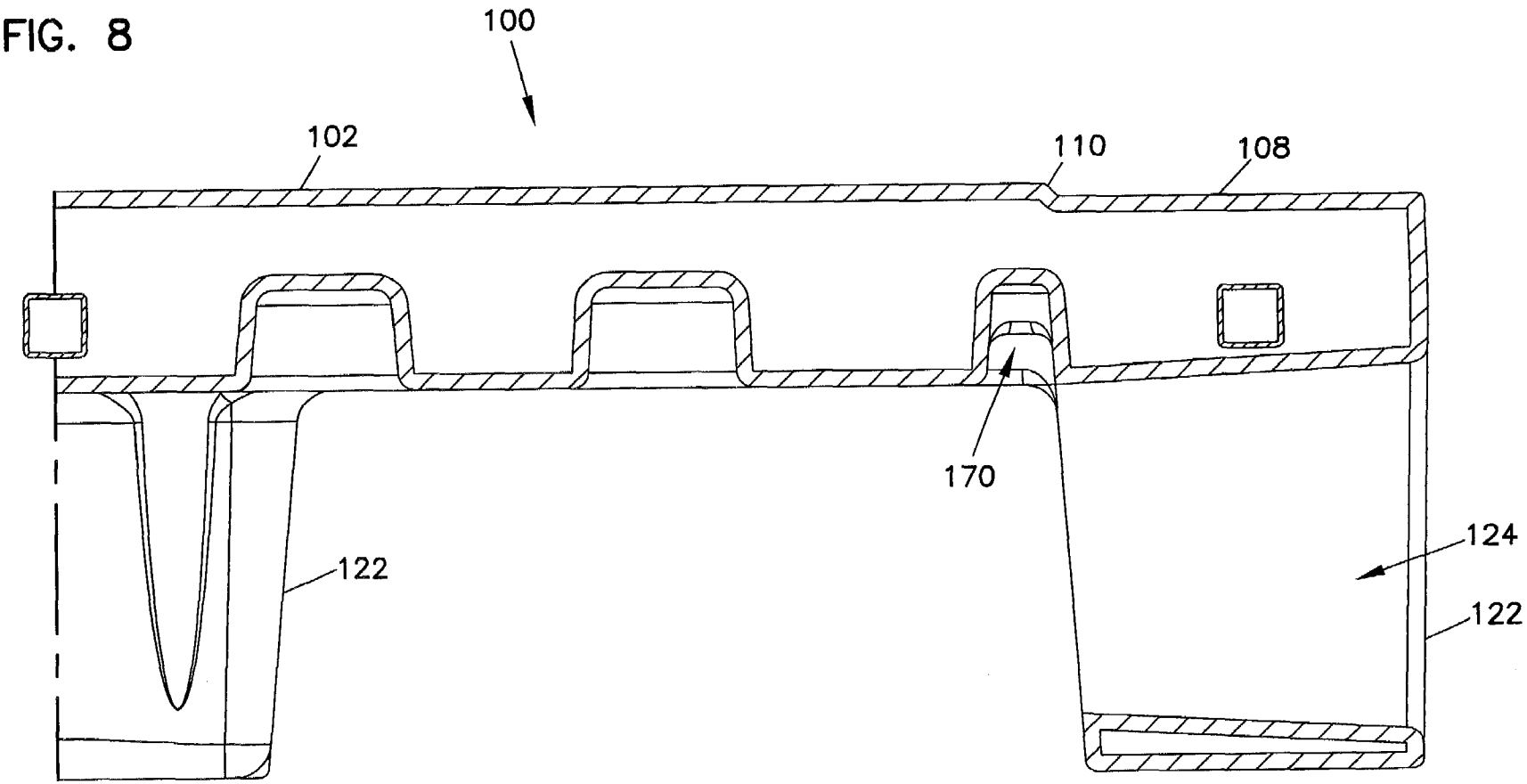
FIG. 8 is a detail sectional view of an underside of the pallet taken along line 8-8 of FIG. 4.
Figure 9:
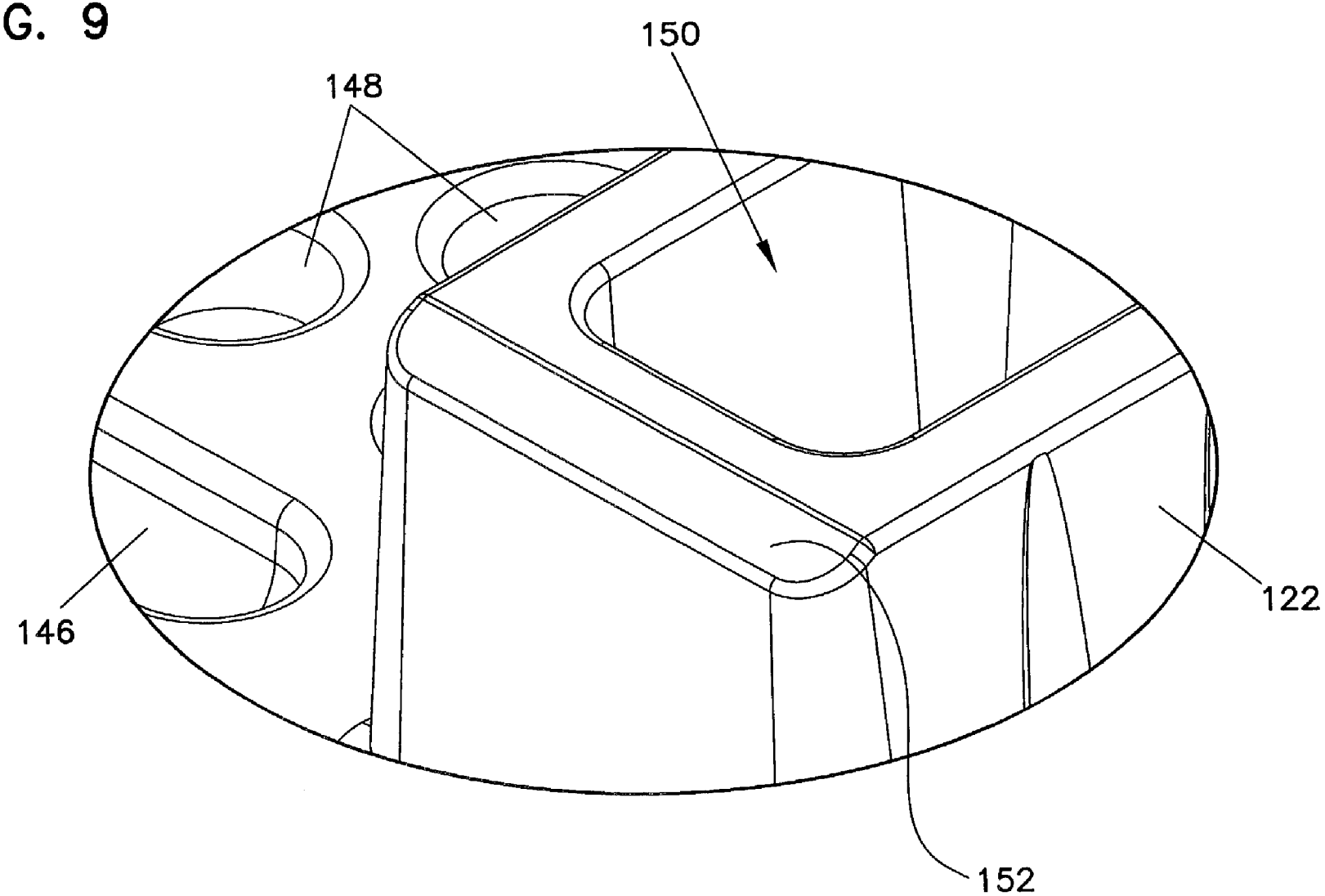
FIG. 9 is a detail perspective view of a portion of a support member for the pallet shown in FIG. 1.

As shown in FIGS. 1, 2 and 5, the pallet 100 includes runners 120 with orifices, also known as cores 124 extending substantially vertically through the runners 120. The orifices 124 are aligned with the orifices 124 of the other runner 120 and provide for insertion of forklift tines, pallet jacks or hand jacks for handling the pallets 100. The orifices 124 have a height of approximately four inches (10 cm) in a preferred embodiment to provide for easy insertion of equipment tines. In addition, the runners 120 define portions extending below the orifices 124 known as straps 140. The straps 140 are relatively thin, typically having a height on the order of 15 mm so that a pallet jack may be rolled over the top of the strap 140 and inserted under the pallet deck 102 with minimal resistance. However, the straps 140 also provide structural support to the runners 120. For added support, dimples 138 are formed in a spaced apart pattern on the underside of the straps 140. The offset dimple pattern and the size of the dimples 138 provide structural support to the straps 140 and prevent the straps 140 from collapsing when a pallet jack is rolled over the top of the straps 140. As shown in FIG. 8, the orifices 140 have a slight taper from the outside of the orifice toward the center of the pallet to guide and align the tines of the pallet jack or forklift there through.

Figure 4:
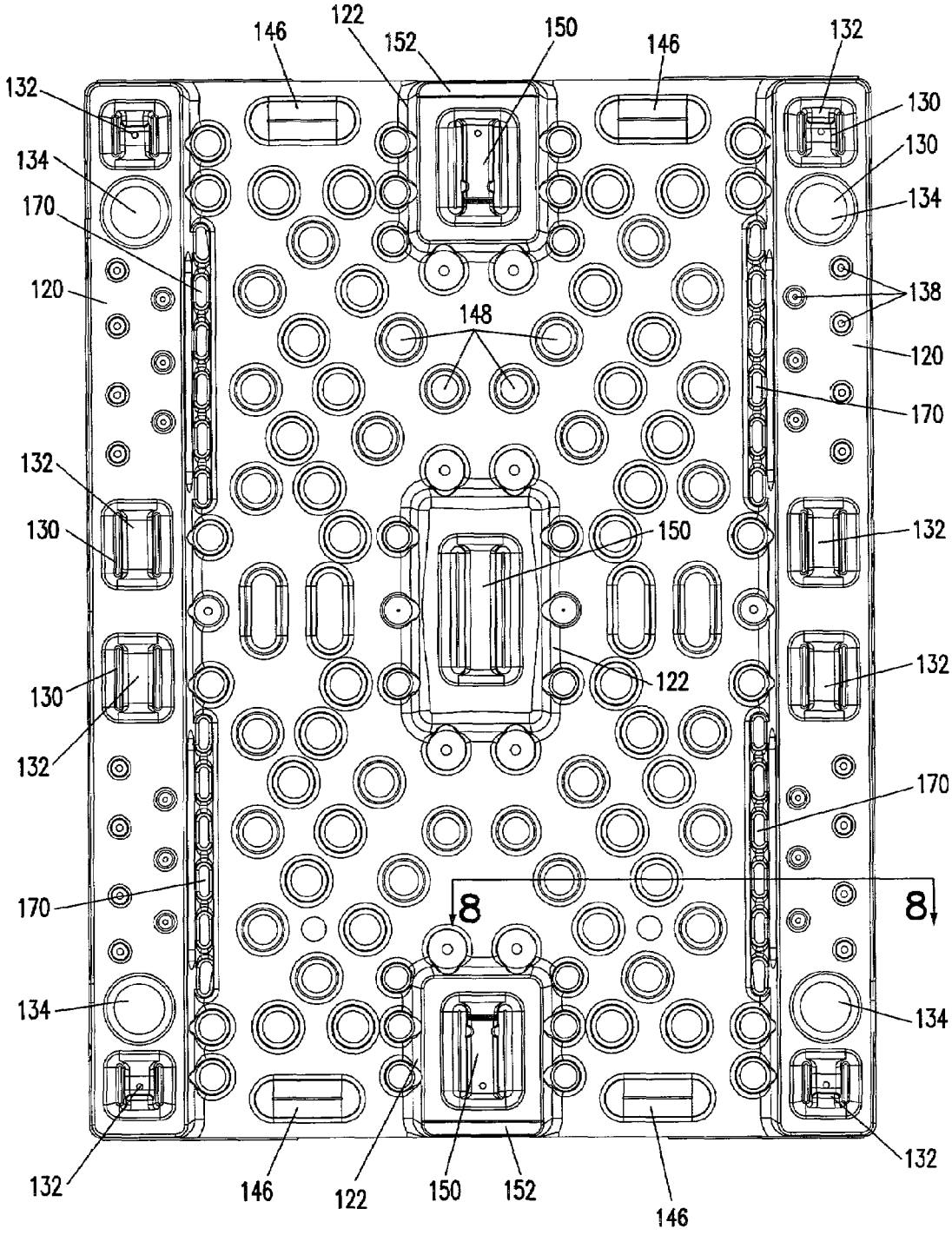
FIG. 4 is a bottom plan view of the pallet shown in FIG. 1.

For added structural support, the runners also include cones 130, as shown most clearly in FIGS. 2 and 4. The cones 130 provide a deep recess extending substantially to the underside of the deck 102 and the runners 120. The cones 130 may be rectangular cones 132 having a substantially pyramidal shape or circular cones 134 having a substantially conical shape, or a combination of rectangular cones 132 and circular cones 134. The cones 130 provide added structural support, improving pallet performance. In one embodiment, the runners 120 include the cones 130 arranged in pairs that alternate with the orifices 124 for greater structural support.

Referring to FIGS. 4 and 8, the pallet 100 is molded with slots 170 extending upward into the deck 102 proximate the runners 120 at the orifices 140. The slot 170 allows for positioning a section of the mold in the slot during molding of the pallet 100 such that an insert for forming the orifices 124 may be locked to the mold. With a slot 170 receiving a portion of the mold, the mold inserts held in position so that the top portion of each orifice 140 is substantially aligned with the underside of the deck 102. This maximizes the orifice height without requiring a step that may catch a tine or increasing the overall height of the pallet 100. This configuration also ensures that a pallet jack or forklift supports the pallet 100 on the underside of the deck 102. Such a support arrangement improves the load distribution over the pallet 100, rather than concentrating the load at the runner orifices 124.

In addition to the orifices 124 being advantageously sized and positioned to allow insertion of pallet jacks with runners 120, the pallet 100 includes three of the center leg support members 122 or feet that are spaced apart so that the spaced apart members of a pallet jack may insert between the three legs 122. The present invention also has the underside of the deck 102 clear from the obstruction and support to allow for insertion of pallet jacks and forklift tines through the sides of the runners 120 without abutting any deck support structure. The runners 120 and legs 122 are also positioned so that pallet jacks may be inserted from either end of the pallet 100. This provides for four way entry into each pallet 100 with either a fork lift or pallet jacks.

Referring now to FIGS. 2 and 4, the underside of the pallet 100 includes molded handles 146 in the ends of the pallet and a pattern of dimples 148 positioned on the underside of the pallet 100 for additional structural support and weight savings. The legs 122 also include a chamfered outer end edge 152. The pallets 100 often are utilized with a conveyor system wherein the pallet 100 engages and runs over an end conveyor roller. The chamfered edge is preferably angled 152 at angle greater than 15 degrees to provide for engagement with the roller and decreases the effort required to push the pallet onto the top of such rollers. In a preferred embodiment, each end of the pallet 100 includes legs 122 with the outer chamfered edge 152 providing for easily positioning the pallet 100 onto a conveyor from either end.

Figure 6:
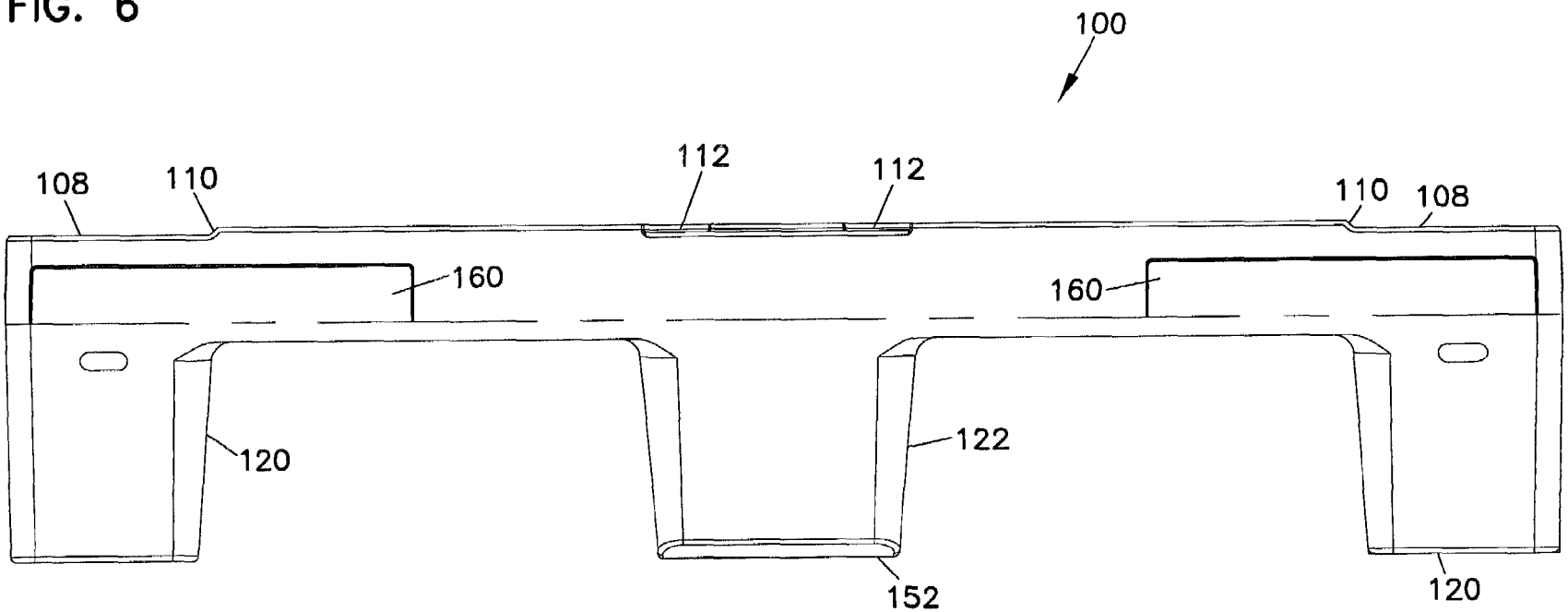
FIG. 6 is an end elevational view of the pallet shown in FIG. 1.

Referring to FIGS. 1, 6 and 7, the ends of the pallet 100 include improved positioning sections 160. The positioning sections 160 are portions protruding outward from the sides of the pallet 100. The raised positioning sections 160 are engaged by complementary members and allow for alignment by pallet handling equipment and greater precision in handling the pallets. The positioning sections 160 are thicker than the standard wall thickness of the pallet 100 and protrude outward for engagement with the alignment portions of the pallet handling equipment. The increased thickness allows for machining of the sections 160 so that tighter tolerances, on the order of plus or minus 2 mm, may be achieved. Such precision is typically not achieved with conventional pallet molding techniques.

To achieve the greater precision and tighter tolerances, the positioning sections 160 are made by a special process. The molded sections are initially created during the molding process with a thicker cross section than the surrounding wall. When the entire pallet 100 has been molded, the excess portions of the raised alignment sections 160 are machined away with precise machining equipment to achieve the tight tolerances. As only the alignment sections 160 are machined rather than the entire side or end of a pallet, waves that may be created due to machining the entire length of the pallet are avoided. Such waves often lead to variances that fall outside of the tolerances that are achieved with the method of the present invention. It can be appreciated that the present method of making the alignment section achieves a pallet 100 having improved handling that is not possible with conventional pallets or convention pallet making techniques.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in that the appended claims are expressed.

What is claimed is:

1. A pallet, comprising:

a deck having a substantially planar upper supporting surface including a plurality of channels formed therein extending across the pallet, wherein the upper supporting surface defines a lowered portion extending along opposed edges of the deck;

a plurality of support members extending from the deck, wherein the support members comprise two first support members, wherein one of the first support members is an elongate member substantially aligned with the lowered portion;

wherein the support members further comprise a second support member, wherein the deck includes an alignment section comprising a central portion projecting substantially to the planar upper supporting surface and defining a recess around the central portion extending to a depth no greater than the channels, wherein the second support member defines a bottom recess wherein each of the elongate members defines two spaced apart orifices extending horizontally there through transverse to the length of the elongate members, and wherein the orifices of the first and second elongate support members are aligned.

2. A pallet according to claim 1, wherein the lowered portion extends the entire length of the deck.

3. A pallet according to claim 1, wherein the support members include a plurality of the second support members intermediate the first support members.

4. A pallet according to claim 1, wherein the bottom recess is selectively configured to receive the central portion of a corresponding support member on a second pallet when the pallets are stacked while empty.

5. A pallet according to claim 1, wherein the bottom recess and central portion are selectively configured to nest the pallets when stacked while empty.

* * * * *